United States Patent [19]

Mozer

[11] 4,433,434

[45] Feb. 21, 1984

[54] METHOD AND APPARATUS FOR TIME DOMAIN COMPRESSION AND SYNTHESIS OF AUDIBLE SIGNALS

[76] Inventor: Forrest S. Mozer, 38 Somerset Pl., Berkeley, Calif. 94707

[21] Appl. No.: 335,312

[22] Filed: Dec. 28, 1981

[51] Int. Cl.[3] ..... G10L 1/00

[52] U.S. Cl. ..... 381/30; 381/35; 381/53; 364/717; 331/78; 84/1.01

[58] Field of Search ..... 381/30, 29, 31–40, 381/51–53; 328/13, 14, 16, 109; 364/717; 375/122; 84/1.01, 1.24; 331/78

[56] References Cited

U.S. PATENT DOCUMENTS

| | | | |
|---|---|---|---|
| 3,968,448 | 7/1976 | Stenning | 328/109 |
| 4,194,427 | 3/1980 | Deutsch | 364/717 |
| 4,214,125 | 7/1980 | Mozer et al. | 381/51 |
| 4,327,419 | 4/1982 | Deutsch et al. | 364/717 |
| 4,395,703 | 7/1983 | Piosenka | 331/78 |

OTHER PUBLICATIONS

Harding, "Generation of Random Digital Numbers", Radio and Electronic Engineer, Jun. 1968 pp. 369–375.

*Primary Examiner*—E. S. Matt Kemeny

*Attorney, Agent, or Firm*—Townsend and Townsend

[57] ABSTRACT

Compression and synthesis techniques and related apparatus for time domain signals, particularly signals whose information content resides in the power spectrum such as speech. Compression techniques include adjusting the phase of harmonic components of a signal unit to obtain an equivalent power spectrum signal of a minimum number of discrete levels. The invention finds application in speech compression and compact speech synthesis devices.

12 Claims, 7 Drawing Figures

METHOD AND APPARATUS FOR TIME DOMAIN COMPRESSION AND SYNTHESIS OF AUDIBLE SIGNALS

BACKGROUND OF THE INVENTION

1. Field of Invention

The invention relates to information compression techniques applicable to audible sounds and particularly to speech compression, storage, transmission and synthesis techniques. More particularly, the invention is applicable to time domain speech compression and synthesis. The invention also finds application in fields where the information content resides in the power spectrum but not the phase components of the signal.

Normal speech and like audible sounds contain about 100,000 bits of information per second. Storage and transmission of large quantities of such information can be prohibitive in cost, bandwidth and storage space. Hence, there is a substantial need to eliminate storage and transmission of any redundant or otherwise unnecessary information in speech and like audible signals. Speech compression and synthesis techniques have been developed to address this problem of information storage and transmission.

Compression techniques have the advantage of decreasing the information content of the waveform so as to decrease the required transmission bandwidth and storage requirements. The major challenge, however, is to minimize the information content of the compressed information with minimal degradation of signal intelligibility and quality.

It has been determined that speech and like audible sounds exhibit certain characteristics which can be exploited to minimize information redundancy while retaining essential quality characteristics. The energy source, for example, may be either a voiced or unvoiced excitation. In speech, voiced excitation is achieved by periodic oscillation of the vocal chords at a frequency called the pitch frequency for minimum periods called pitch periods. The vowel sounds normally result from such a voiced excitation.

Unvoiced excitation is achieved by passing air through the vocal system without causing the vocal chords to oscillate. Examples of unvoiced excitation includes the plosives such as /p/ (as in "pow"), /t/ (as in "tall") and /k/ (as in "ark"); the fricatives such as /s/ (as in "seven"), /f/ (as in "four"), /th/ (as in "three"), /h/ (as in "high"), /sh/ (as in "shell"), /ch/ (as in the German word "acht"); and all whispered speech. Voiced sounds exhibit quasi-periodic amplitude variation with time. However, unvoiced sounds, such as the fricatives, the plosives and other audio signals, including moving air, the closing of a door, the sounds of collisions, jet aircraft, and the like, have no such quasi-periodic structure, resembling rather random white noise.

It is well known that the intelligibility of speech phonemes and unvoiced sounds is determined by the power spectrum rather than the phase angles of the time domain signal. The power spectrum is analyzed by the human brain through signal averaging over a time on the order of ten milliseconds.

A problem related to the storage of time domain amplitude information is the apparent need for relatively high resolutions amplitude storage. For example, eight to twelve bits of amplitude accuracy are required to accurately categorize the amplitude of each sample in a sequence. Each amplitude level represents two possible digitizations depending upon sign. Conventional wisdom suggests that reduction of the number of amplitude levels reduces the resolution of the signal and thereby degrades intelligibility. What is needed in this instance is a technique to reduce the resolution of the waveform without unduly decreasing the intelligibility of the resultant audible signal.

2. Description of the Prior Art

Compression and synthesis of speech signals and the like have been studied for several decades. (See, for example, Flanagan, *Speech Analysis, Synthesis and Perception,* Springer-Verlag, 1972.) Interest in the topic has accelerated with the increased technical ability to fabricate complex electronic circuits in a single integrated circuit through the techniques of Large-Scale Integration.

Compression and synthesis techniques are generally divided into two categories, frequency domain techniques and time domain techniques. These techniques are distinguished in terms of the type of data stored and utilized. Frequency domain synthesis achieves its compression by storing information on the important frequencies in each speech segment or pitch period.

Examples of frequency domain synthesizers are given in U.S. Pat. No. 3,575,555 and in 3,588,353.

Time domain synthesizers, in contrast, store a representative version of the signal in the form of amplitude values as a function of time.

Known digital time domain compression techniques have been described in U.S. Pat. No. 3,641,496 to Slavin; U.S. Pat. No. 3,892,919 to Ichikawa; and in U.S. Pat. No. 4,214,125 to Mozer et al.

In 1975, the first LSI time domain speech synthesizer was fabricated using compression techniques described in U.S. Pat. No. 4,214,125. Since the introduction of the time domain speech synthesizer, various versions of LSI speech synthesizer devices have been designed and introduced for a variety of applications, particularly in the consumer markets.

A method for storing and reading out musical waveforms, which are characterized by readily identifiable periodicity is described in Deutsch et al. U.S. Pat. No. 3,763,364. Both this patent and U.S. Pat. No. 4,214,125 describe phase adjusting techniques to achieve equivalent waveforms characterized by time symmetry. Nothing in either of these patents suggest techniques for eliminating the characteristic periodicity of unvoiced sounds or techniques utilizing phase adjusting to optimize amplitude resolution.

SUMMARY OF THE INVENTION

The information of a time domain signal whose information content resides primarily in the power spectrum, as opposed to phase, such as sufficiently segmented speech sound, may be digitally amplitude compressed with minimal degradation of resolution by deriving an equivalent discrete amplitude level signal of the same power spectrum but differing phase.

The equivalent signal is derived by adjusting the phase of the harmonic components of the source signal to obtain a best match to a selected limited number of discrete levels at predefined time intervals. The analysis of the harmonic components is preferably through examination of the Fourier transform of a sampled segment of the time domain source signal. The invention has application to compression and synthesis of signals intended for audible detection such as speech, which consists of both voiced (quasi-periodic) and unvoiced (aperodic) sounds.

The compression technique may be employed separately or combined with other time domain compression and synthesis techniques to produce an output requiring minimized storage space and bandwidth.

One of the primary objects of the invention is to develop new methods for compressing the information content of speech signals and like audible waveforms without substantially degrading the quality of the resulting sound in order to reduce the cost and size of speech synthesizing devices. In particular, an object of the invention is to provide a compression method particularly applicable to time domain synthesis.

A further object of the invention is to reduce the amount of digital information required to be stored or transmitted thereby to reduce the bandwidth requirements and memory size requirement is an analog output signaling system.

The foregoing and other objectives, features, and advantages of the invention will be more readily understood upon consideration of the following detailed description of certain specific embodiments of the invention taken in conjunction with the accompanying drawings.

DESCRIPTION OF SPECIFIC EMBODIMENTS

Figure 1:
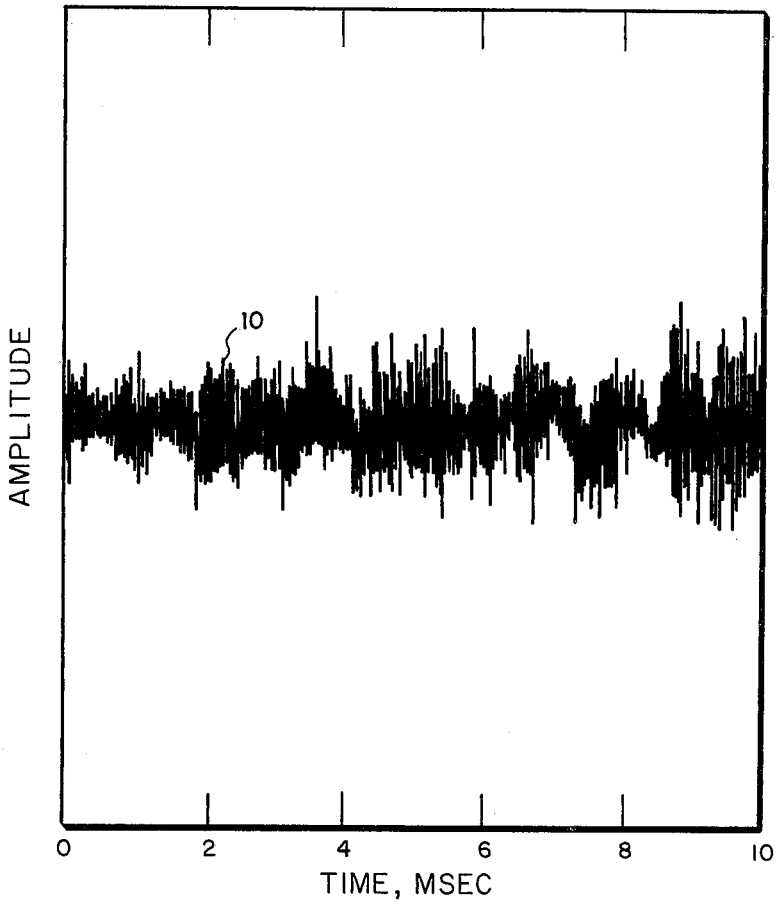
FIG. 1 is a waveform diagram of the amplitude of a signal as a function of time.

Since the intelligibility of different voiced and unvoiced sounds is contained in the power spectrum rather than in the phase angles, certain liberties can be taken with the phase characteristics of the aperiodic (unvoiced) and quasi-periodic (voiced) sounds. For example, Fourier analysis of a sound indicates that a seemingly infinite number of equivalent signals exists whose power spectra are equivalent to a source signal but which differ only in phase. For example, let the amplitude of a waveform as a function of time F(t) be represented by the equation:

$$F(t) = \sum_n A_n \cos\left(\frac{2\pi nt}{T} + \phi_n\right) \quad (1)$$

where T is the time duration of the waveform of interest and $A_n$ and $\phi_n$ are constants which are determined such that Equation (1) exactly reproduces the original or source waveform within sampling accuracy.

For example, consider a waveform of interest containing 128 digitizations. Equation (1) must be satisfied each of these 128 times so that the waveform may be viewed as 128 equations having 128 unknown parameters for which there is a solution. Half of these unknowns are the amplitudes $A_n$ while the other half of these unknowns are the phase angles $\phi_n$. Only the amplitudes $A_n$ need to be equivalent to the source waveform for audible information, since the human ear is substantially insensitive to phase relation.

According to the invention, information content of both voiced and unvoiced sounds can be optimized by phase adjusting the power spectrum of a signal equivalent to a source signal such that the amplitudes of the equivalent signal are limited to a selected discrete maximum number of choices. Such a method is illustrated in connection with FIGS. 1 through 5.

Figure 2:
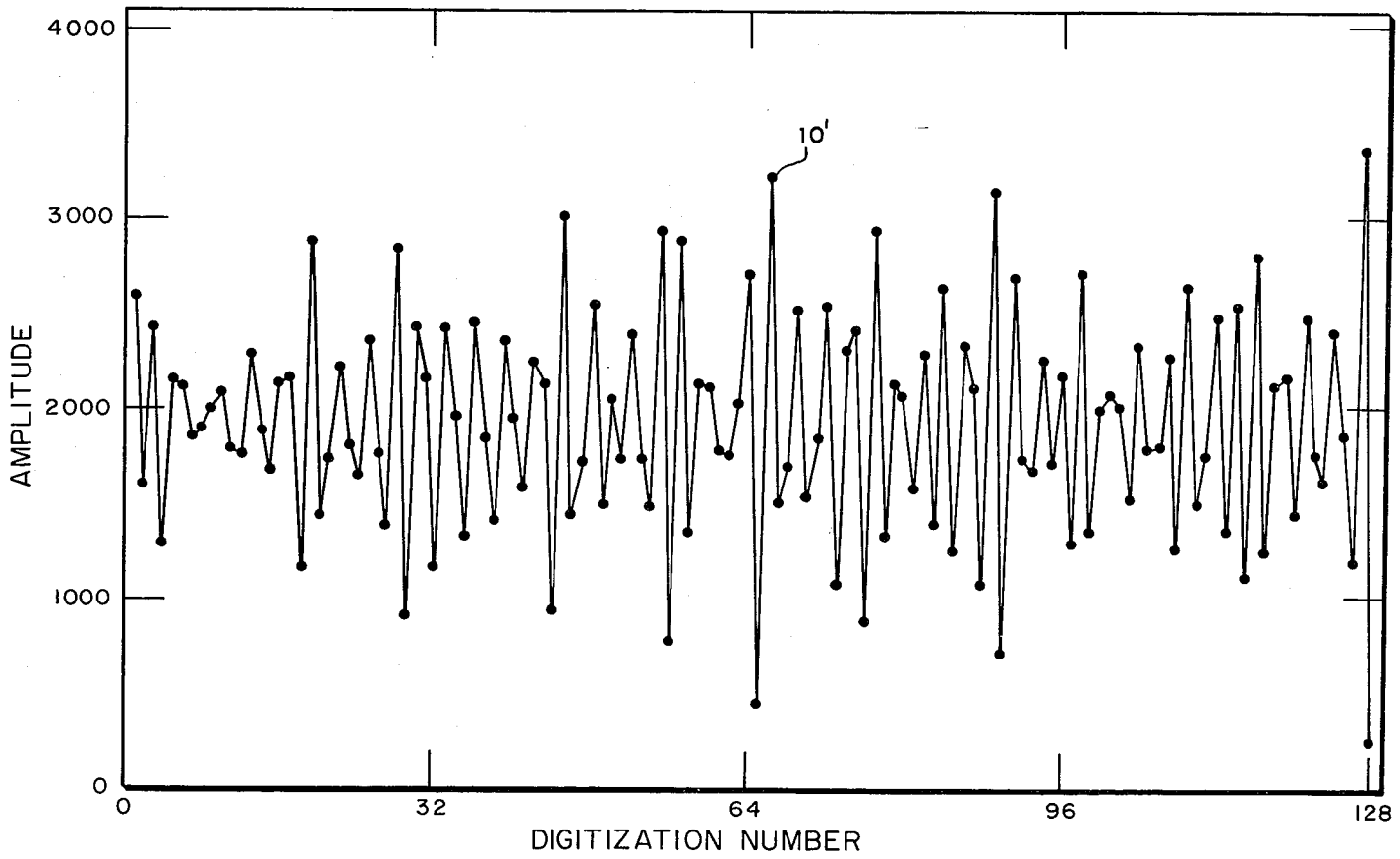
FIG. 2 is a waveform diagram of the amplitude as a function of time reconstructed from 128 samples of the signal of FIG. 1.

Turning to FIG. 1 for example there is shown an amplitude diagram of a waveform 10 of a phoneme, in this case the phoneme /s/. FIG. 2 shows a waveform 10' which is a ten millisecond digitization of the phoneme of FIG. 1 comprising 128 samples digitized to 12-bit accuracy. Consequently, there are 4,096 possible amplitude levels of each of the 128 samples. The intelligibility of the segment of 128 samples is associated with 64 amplitude values $A_n$ of Equation 1 and not with 64 phase values $\phi_n$. Hence any or all of the 64 phase values may be changed essentially arbitrarily without changing the intelligibility of the waveform even though modification of the phases may substantially alter the amplitude values as a function of time.

Figure 3:
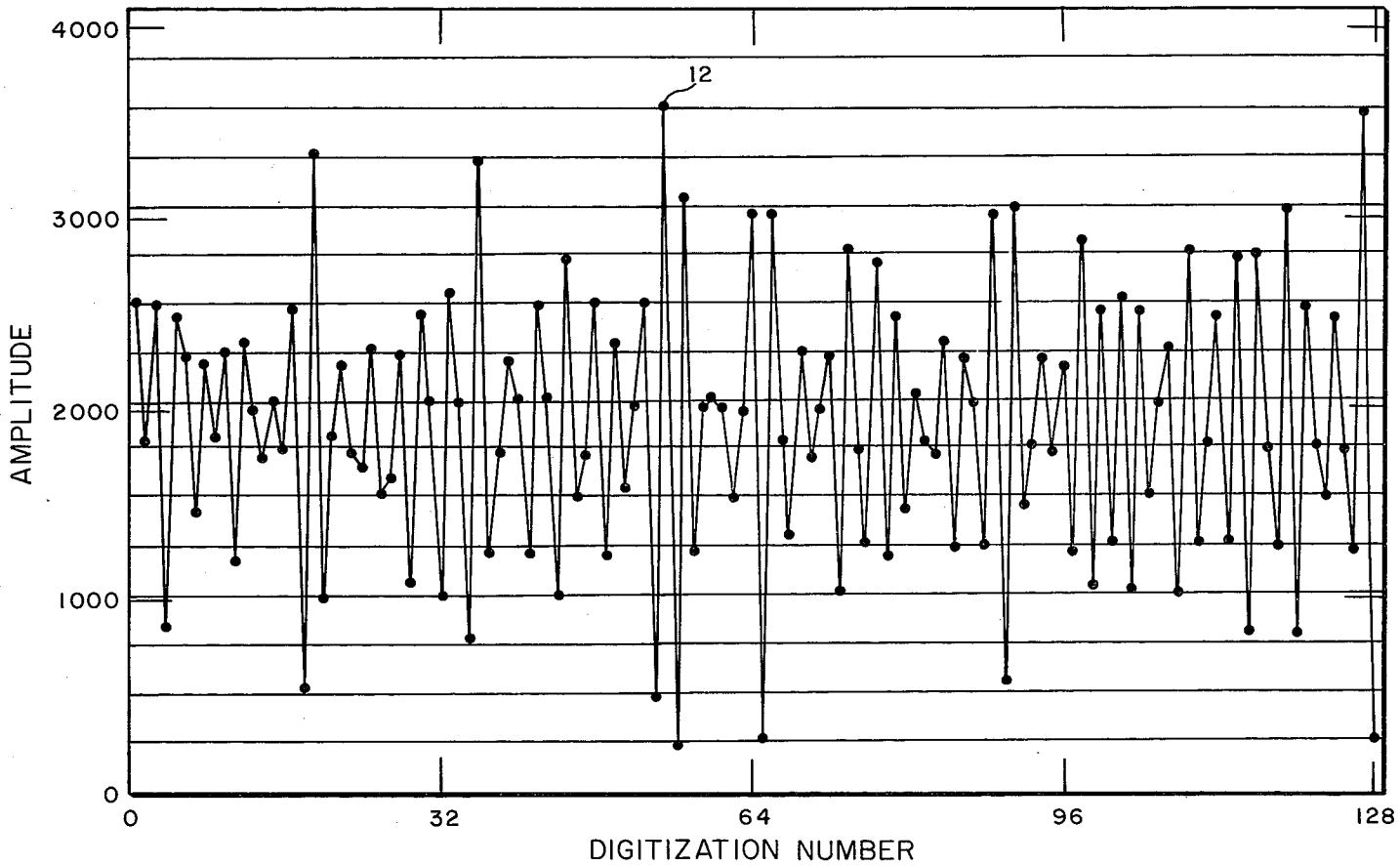
FIG. 3 is a waveform diagram of the amplitude as a function of time having the same power spectrum as the waveform of FIG. 2 which has been adjusted so that the amplitudes tend to cluster about sixteen discrete amplitude values.

FIG. 3 illustrates one waveform 12 of many waveforms which have a power spectrum equivalent to that of waveform 10' in FIG. 2. Waveform 12 was obtained by selectively adjusting the phase of the Fourier components $\phi_n$ in Equation 1 forming the sampled waveform 10' of FIG. 2. The resultant waveform 12 in FIG. 3 has the interesting property that its 128 digitizations tend to cluster about 16 amplitude levels. The 16 amplitude levels are represented by only four bits of information. As compared with the 12-bit amplitude digitization of the source signal 10, a compression factor of 3 is thus achieved.

Figure 4:
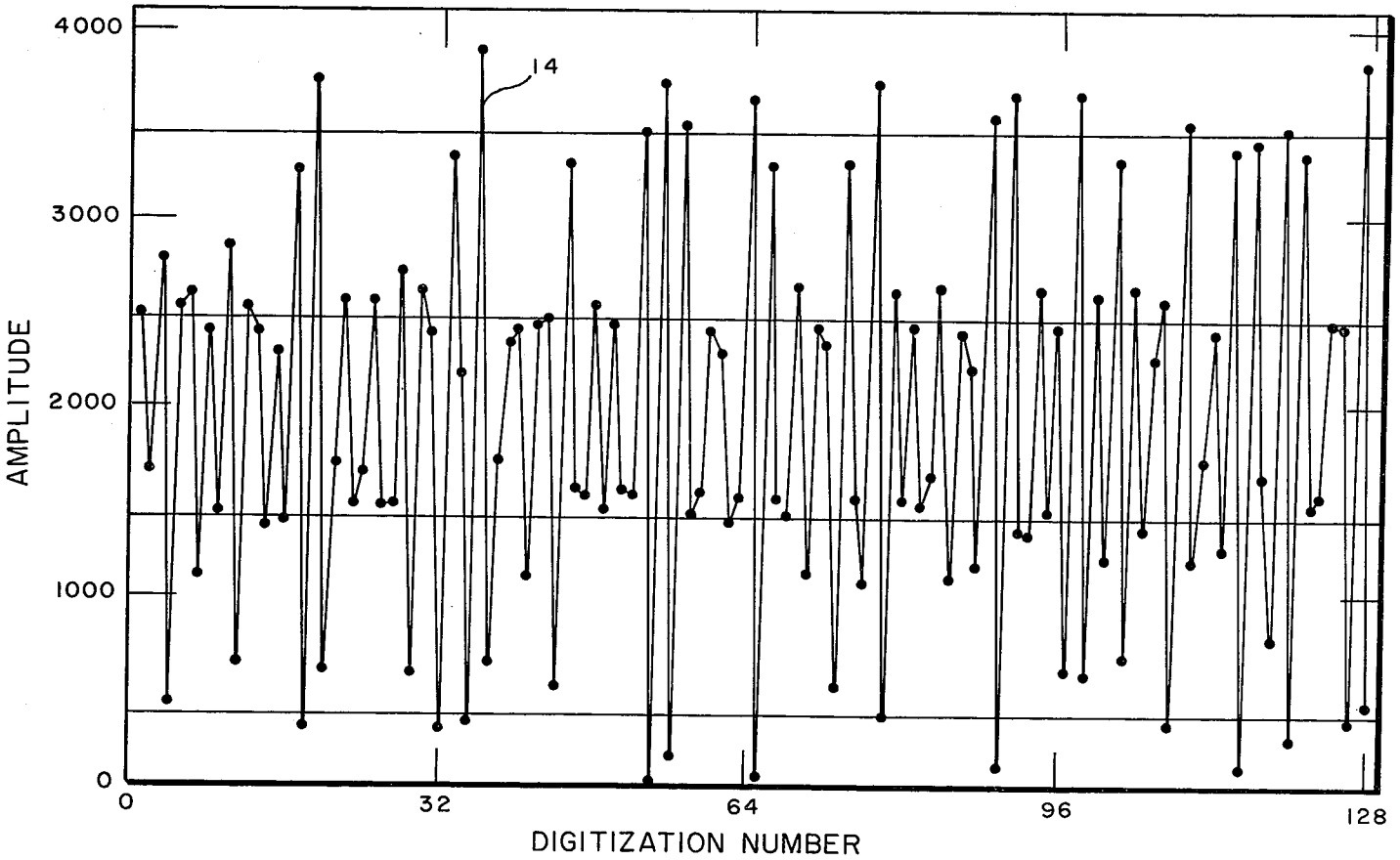
FIG. 4 is a waveform diagram of the amplitude as a function of time of a signal having the same power spectrum as that of the waveform of FIG. 2 but which has been adjusted so that the samples of the amplitudes tend to cluster around four discrete amplitude values.

However, substantially more compression can be achieved without undue degradation of the signal by adjusting the phase components so that the time domain amplitude waveform samples tend to cluster around eight or even as few as four amplitude levels. Referring to FIG. 4 there is shown a waveform 14 as a function of time which employs the same Fourier amplitude components as the waveform 10' of FIG. 2. The waveform 14 has the property that its sampled values tend to cluster about four distinct amplitude values. The waveform 14 suggests that it may be represented to a good approximation by only two bits of information per sample, a compression factor of six as compared to the source 12-bit amplitude digitization.

Figure 5:
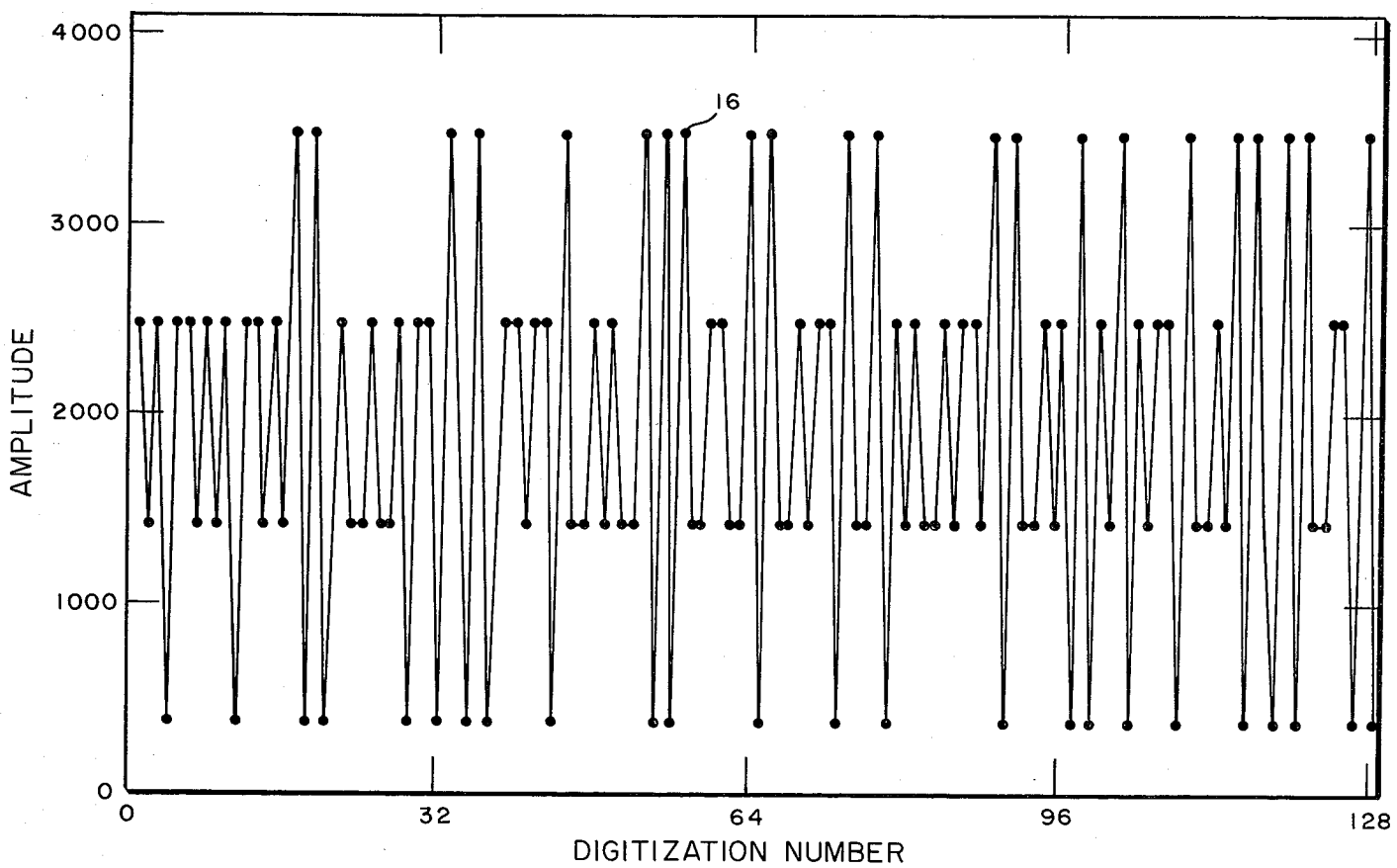
FIG. 5 is a waveform diagram of a signal amplitude as a function of time wherein the signal has been constrained to exactly four possible amplitude values.

Turning to FIG. 5, there is shown a sampled waveform 16 which is a best fit reconstruction of the waveform of FIG. 4 with exactly four digitization levels. Specifically, each sample of the waveform 14 of FIG. 4 has been analyzed and then approximated to the nearest four-level representation. The intelligibility of the signal is acceptable for audio purposes because the main alteration in the signal has been in the phases of the harmonic components.

Figure 6:
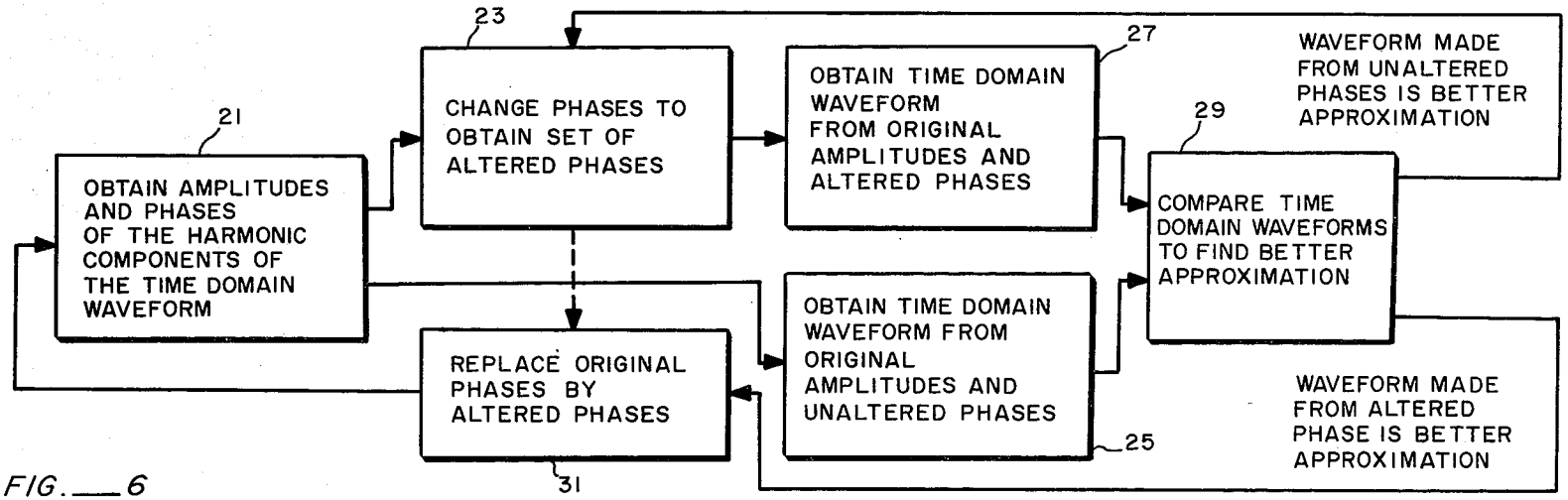
FIG. 6 is a block diagram illustrating the procedure for developing a time domain signal employing a restricted set of allowed amplitudes which has a power spectrum equivalent to a source time domain signal.

The technique for developing the minimal amplitude level segment is as follows: Referring to FIG. 6, the first step typically performed with the help of a computer is to obtain the amplitudes and phases of the harmonic components of the time domain waveform (step 21). The harmonic components are preferably obtained by Fourier analysis of the time segment of interest from which is obtained a set of amplitude coefficients and phase coefficients for trigonometric functions of various order. Theoretically, any set of transcendental functions could be used to reconstruct the harmonic components so long as amplitude and phase components can be separated. As the next step, some or all of the phase components are altered in either a random or some determinate manner to obtain a new time domain waveform with the same power spectrum (step 23). The resultant set of equations is then inverse transformed first to obtain the time domain waveform from the original amplitudes with unaltered phases (step 25) and then to obtain the time domain waveform of the original amplitudes with altered phases (step 27).

The resultant two time domain waveforms are then each compared with a restricted set of allowed time domain amplitude values to determine which resultant waveform is better approximated by the restricted set of allowed values (step 29). If the waveform altered by step 23 is better approximated by, for example, sixteen levels, then the phase values of the altered waveform are stored in place of the phase values of the unaltered waveform in the set of frequency domain equations (step 31). However, if the altered waveform does not improve upon the approximation of the original waveform, then the phase components of the set of corresponding frequency domain equations are once more changed (step 23) and a new time domain waveform is reconstructed with the altered phases (step 27) for comparison with the restricted set of allowed time domain amplitude values (step 29). Ultimately, the desired time domain waveform is obtained whose power spectrum is, within acceptable limits, equivalent to the original time domain waveform.

Various mathematical optimization techniques are known for this process which might be implemented on a digital computer. For example, the comparison might involve calculating the sum of the squares of the differences between each point in given waveform and the corresponding point in its representation with a restricted set of allowed amplitudes. This technique would optimize for the least squares difference.

While the foregoing example involved an unvoiced vocal sound as an example, the technique applies equally well to any time domain information signal wherein the information resides primarily in the power spectrum rather than the phase information of the signal. For example, all forms of speech, including voiced sounds which are detected primarily by amplitude techniques, may be analyzed and compressed according to the invention.

Figure 7:
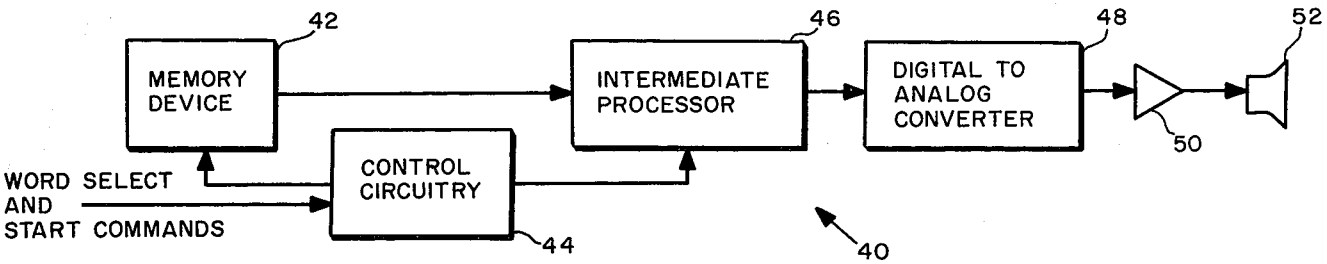
FIG. 7 is a block diagram of a time domain speech synthesizer according to the invention.

The invention may be utilized in a compact speech synthesizer such as is manufactured by National Semiconductor of Santa Clara, California in accordance with the principles of time domain speech synthesis. FIG. 7 is an example of a device 40 according to the invention. A memory device 42 stores the processed and compressed data. The memory device 42 is addressed by control circuitry 44 to produce data and for output to an intermediate processor 46 which reconstructs the desired output signal in digital form. The control circuitry 44 also instructs the intermediate processor 46. The digital output of intermediate processor 46 is coupled to a digital-to-analog converter 48, which is used to excite an amplifier 50 which drives a speaker 52.

The foregoing discussion principally concerns the optimization of audible signals which apply to speech analysis, compression and synthesis. The invention may be applied equally well to other information where the information content is substantially limited to the spectral characteristic of the signal rather than to the phase. It is therefore not intended that this invention be limited except as indicated by the appended claims.

I claim:

1. A method for compressing a time domain information signal, said method comprising the steps of:

receiving said information signal; and adjusting the phase of harmonic components of said received signal to produce an equivalent signal, said equivalent signal having sampled amplitude values at selected sample times, said amplitude values being limited to a selected maximum number of amplitude levels less than the number of amplitude levels utilized to define said information signal at said selected sample times, said equivalent signal having a power spectrum substantially the same as said information signal.

2. The method according to claim 1 wherein the number of permissible peak non-zero amplitude values is no more than two magnitude levels.

3. The method according to claim 1 or 2 wherein the permissible peak non-zero amplitude values are symmetric with respect to a zero reference level.

4. An apparatus for compressing a time domain information signal comprising:

means operative to receive said information signal; and means coupled to said receiving means for adjusting the phase of harmonic components of said received information signal to produce an equivalent signal having a power spectrum substantially the same as said information signal, said adjusting means further producing said equivalent signal as a serial sequence of sampled amplitude values at selected sample times which is limited to a selected maximum number of amplitude levels less than the number of amplitude levels utilized to define said information signal at said selected sample times.

5. The apparatus according to claim 4 further including means limiting the number of permissible non-zero amplitudes values at selected sample times to no more than two magnitude levels.

6. The apparatus according to claim 4 or 5 further including means limiting permissible non-zero amplitude values at selected sample times to values which are symmetric with respect to a zero reference level.

7. A method for compressing a time domain information signal whose information content resides mainly in its power spectrum comprising the steps of:

digitizing a finite segment of said time domain signal;

analyzing said digitized waveform to determine amplitude and phase parameters in terms of harmonically related transcendental functions; and altering the magnitude and sign of selected ones of said phase parameters without modifying said amplitude parameters to obtain an equivalent time domain signal whose amplitude in the time domain may be reconstructed by a selected limited maximum number of finite amplitude values less than the number of amplitude values required to digitize said information signal.

8. The method according to claim 7 wherein said altering step comprises Fourier transforming said time domain information signal into the frequency domain to determine frequency and phase components of said information signal.

9. An apparatus for synthesizing from compressed information an output signal which is substantially equivalent to a source time domain signal whose information content resides mainly in its power spectrum, said apparatus comprising:

memory means for storing digital representations of the amplitude of segments of a compressed time domain signal and for storing instructions correlating said segments to said output signal; and means responsive to said digital representations and said instruction signals for constructing said output signal from said segments, said segments having a limited maximum number of finite amplitude values at selected sample times and said output signal having a power spectrum substantially equivalent to but having phase components differing from said source signal.

10. The apparatus according to claim 9 further including means for limiting the number of non-zero amplitude values at selected sample times to no more than two magnitude levels.

11. The apparatus according to claim 9 or 10 further including means limiting permissible non-zero amplitude values which are symmetric with respect to a zero reference level.

12. A method for synthesizing from compressed information an output signal which is substantially equivalent to a source time domain signal whose information content resides mainly in its power spectrum, said method comprising:

storing digital representations of the amplitude of segments of a compressed time domain signal with representations of instruction signals correlating said segments to said output signal; and constructing said output signal from said segments in response to said instruction signals, said segments having a limited maximum number of finite amplitude values at selected sample times and said output signal having a power spectrum substantially equivalent to but having phase components differing from said source signal.

* * * * *